US009296507B2

(12) United States Patent
Giuliani et al.

(10) Patent No.: US 9,296,507 B2
(45) Date of Patent: Mar. 29, 2016

(54) VACUUM TRANSFER ELEMENT AND METHOD FOR TRANSFERRING TUBULAR LABELS

(75) Inventors: Mattia Giuliani, Parma (IT); Mirko Rossi, Parma (IT); Stefano Molinari, Parma (IT); Andrea Bocchi, Parma (IT); Gastone Piazza, Parma (IT)

(73) Assignee: SIDEL S.p.A. con Socio Unico (IT)

( * ) Notice: Subject to any disclaimer, the term of this patent is extended or adjusted under 35 U.S.C. 154(b) by 379 days.

(21) Appl. No.: 13/984,712

(22) PCT Filed: Dec. 9, 2011

(86) PCT No.: PCT/IB2011/055591

§ 371 (c)(1),
(2), (4) Date: Oct. 25, 2013

(87) PCT Pub. No.: WO2012/107812

PCT Pub. Date: Aug. 16, 2012

(65) Prior Publication Data

US 2014/0048206 A1 Feb. 20, 2014

(30) Foreign Application Priority Data

Feb. 11, 2011 (IT) ..... TO20110009 U
Apr. 21, 2011 (IT) ..... TO2011A0356

(51) Int. Cl.
*B65C 3/14* (2006.01)
*B65C 9/08* (2006.01)
(Continued)

(52) U.S. Cl.
CPC . *B65C 3/14* (2013.01); *B65C 3/065* (2013.01); *B65C 9/08* (2013.01); *B65C 9/1819* (2013.01); *B65C 9/1823* (2013.01); *B65C 9/1826* (2013.01)

(58) Field of Classification Search
CPC ..... B65C 3/065; B65C 3/14; B65C 9/1815; B65C 9/1823; B65C 9/1826
See application file for complete search history.

(56) References Cited

U.S. PATENT DOCUMENTS 4,208,237 A * 6/1980 Heyne ..... B29C 31/002 156/446
4,357,788 A 11/1982 Amberg
(Continued)

FOREIGN PATENT DOCUMENTS

DE 19716079 A1 4/1998
EP 0805110 A1 11/1997
(Continued)

OTHER PUBLICATIONS

"International Application Serial No. PCT/IB2011/055591, International Search Report mailed Mar. 28, 2012", 4 pgs.
(Continued)

*Primary Examiner* — Mark A Osele
(74) *Attorney, Agent, or Firm* — Schwegman Lundberg & Woessner, P.A.

(57) ABSTRACT

There is described a vacuum transfer element for transferring a tubular label having a first axis (A) form a first to a second position, comprising a first surface which may reciprocate along a second axis (E) parallel to first axis (A), comprises a plurality of ports and is adapted to cooperate with an outer side, opposite to first axis (A), of said tubular label; first ports are selectively connectable to a vacuum source to establish a vacuum suction action on outer side, at least when first surface moves from first to second position; surface is angularly fixed relative to said second axis (E); first surface is angularly fixed relative to second axis (E).

24 Claims, 7 Drawing Sheets

(51) Int. Cl.
*B65C 3/06* (2006.01)
*B65C 9/18* (2006.01)

(56) References Cited

U.S. PATENT DOCUMENTS

| | | | | | |
|---|---|---|---|---|---|
| 5,715,651 | A * | 2/1998 | Thebault | B65C 3/065 53/292 |
| 6,016,641 | A * | 1/2000 | Nagano | B65C 3/065 53/292 |
| 7,765,842 | B2 | 8/2010 | Boltshauser | |
| 2001/0002614 | A1 | 6/2001 | Menayan | |
| 2002/0017083 | A1 * | 2/2002 | Frankefort | B65C 3/065 53/585 |
| 2007/0056679 | A1 | 3/2007 | Orlandi | |

FOREIGN PATENT DOCUMENTS

| | | | | |
|---|---|---|---|---|
| EP | 1151847 | A1 | 11/2001 | |
| EP | 2554484 | A1 | 2/2013 | |
| GB | 730404 | A * | 5/1955 | B65C 3/14 |
| JP | 2011-213377 | A | 2/2013 | |
| WO | WO-2004/065273 | A2 | 8/2004 | |
| WO | WO-2011/010248 | A1 | 1/2011 | |
| WO | WO-2011/114358 | A1 | 9/2011 | |
| WO | WO-2012/107812 | A1 | 8/2012 | |

OTHER PUBLICATIONS

"International Application Serial No. PCT/IB2011/055591, Written Opinion mailed Mar. 28, 2012", 5 pgs.

* cited by examiner

VACUUM TRANSFER ELEMENT AND METHOD FOR TRANSFERRING TUBULAR LABELS

RELATED APPLICATIONS

This application is a U.S. National Stage Filing under 35U.S.C. 371 from International Application No. PCT/IB2011/1055591, filed on Dec. 9, 2011, and published as WO 2012/107812 A1 on Aug. 16, 2012, which claims the benefit under 35 U.,S.C. 119 to Italian Application No. TO2011U000009, filed on Feb. 11, 2011, and Italian Application No.TO2011A000356, filed on Apr. 21, 2011; which applications and publication are incorporated herein by reference in their entirety.

TECHNICAL FIELD

The present invention relates to a vacuum transfer element and to a method for transferring a tubular label.

BACKGROUND ART

As it is generally known, labeling machines are used to apply labels to containers or articles of all sort. Typically used with beverage bottles or vessels are tubular labels (commonly called "sleeve labels"), which are obtained by:

- cutting the web unwound from a supply roll into a plurality of rectangular or square labels of a heat-shrinkable material;
- bending each label in a cylindrical configuration such that the opposite vertical edges overlap one another; and
- welding the overlapped edges of each cylindrical label.

In particular, a labeling machine is known comprising a carousel mounted to rotate about a substantially vertical first longitudinal axis, and having a number of carrier units, each for feeding a respective article between an input station, where the articles are fed onto the conveyor wheel, and an output station, where the articles are fed off the carousel.

Each carrier unit comprises a tubular upright fixed to the carousel, and having a second longitudinal axis substantially parallel to the first axis; a supporting spindle, which engages the upright in rotary and axially-sliding manner, has a top end defining a substantially horizontal supporting surface for a respective article, and is bounded externally by a cylindrical lateral surface connectable to a pneumatic suction device; and a top retaining member, which cooperates with the spindle to keep the article upright on the supporting surface.

The spindle is movable axially between a lowered position—in which the spindle is substantially housed inside the upright, so the carrier unit can receive an article at the input station and release the article at the output station—and a raised position—in which the spindle projects from the upright, so the lateral surface of the spindle can receive and retain a label.

The spindle also rotates about the second axis, to wind the label completely about the spindle into a tubular configuration having a longitudinal overlap defined by superimposed portions of the label, and which is heat sealed longitudinally by a heat-seal bar associated with the carrier unit.

Once the label is heat sealed, and by combining the downward movement of the spindle inside the upright with deactivation of the pneumatic suction device, the label is released from the lateral surface of the spindle, is retained on the upright by a top annular edge of the upright, and is engaged in sliding manner by a respective article.

The articles coming off the carousel are fed, substantially upright, by a linear conveyor device through a heating device to heat-shrink the labels about the articles.

Because the labels are fed through the heating device still in contact with a supporting surface of the conveyor device, known labeling machine of the above type have several drawbacks, mainly due to not allowing selective control of the position of the labels along the articles, and as such as are fairly inflexible.

In order to overcome the above drawback, a labeling machine is known from WO-A-2011/114358, in the name of the same Applicant.

In detail, the conveyor device of this labeling machine comprises:

- a bottom belt which defines a substantially horizontal supporting surface for the articles coming out from the carousel;
- a top belt which is separated from the supporting surface by a distance substantially equal to the height of the article;
- a positioning unit which interacts with the articles travelling onto the bottom conveyor and is adapted to position the tubular labels in a given final position; and
- a stop device which interacts with the articles upstream of positioning unit and is adapted to arrest the labels in respective given final positions relative to corresponding articles.

In detail, the bottom belt feeds articles with respective labels successively and continuously through positioning unit, which comprises a pair of first brushes and a pair of brushes.

Both first brushes and second brushes counter-rotate relative to each other and are arranged on opposite sides of the articles travelling onto conveyor device.

Second brushes are arranged downstream of first brushes, proceeding according to the travelling direction of the articles onto the conveyor device.

As articles travel onto conveyor, labels are first raised by first brushes from an initial lowered position, in which the labels substantially contact the supporting surface of the bottom branch to an intermediate position, in which the labels substantially contact the top branch; afterwards, labels are lowered by second brushes from the intermediate position to the given final position in which they are arrested by the stop device.

The stop device substantially comprises two endless conveyors arranged on opposite lateral sides of the conveyor device and which have respective branches cooperating with opposite side of the label to arrest this labels in the final given position.

The Applicant has found that the above described solution can be improved, especially as regard to reliability, precision and speed of the positioning of the labels in the given final position.

A need is felt within the industry to obtain labeling machine which can apply tubular labels either to the full body of the containers or to only a portion of the outer surface of relative containers, and which overcomes the above drawback in a simple and economic way.

JP-A-2011-213377 discloses a picker for picking labels. In detail, the picker comprises two members formed to match the diameters of the article. The two members are rotated about an axis between an open and a closed by an opening/closing mechanism, and are raised and lowered along this axis. The inner surface of each member of the picker comprises a plurality of a suction holes connected to a vacuum source.

DISCLOSURE OF INVENTION

Examples provide a vacuum transfer element for transferring a tubular label, which allows to overcome the above need in a straightforward and low-cost manner.

This can be achieved by a vacuum transfer element as claimed in claim 1.

The present subject matter also relates to a method for transferring a tubular label, as claimed in claim 22.

BRIEF DESCRIPTION OF THE DRAWINGS

A non-limiting embodiment of the present invention will be described by way of example with reference to the accompanying drawings, in which.

DETAILED DESCRIPTION

With reference to the FIGS. 1 to 5, number 1 indicates as a whole a module for the application of a plurality of tubular labels 2 of heat-shrinkable material to respective articles 3, in particulars containers or bottle filled with a pourable liquid food product.

Figure 6:
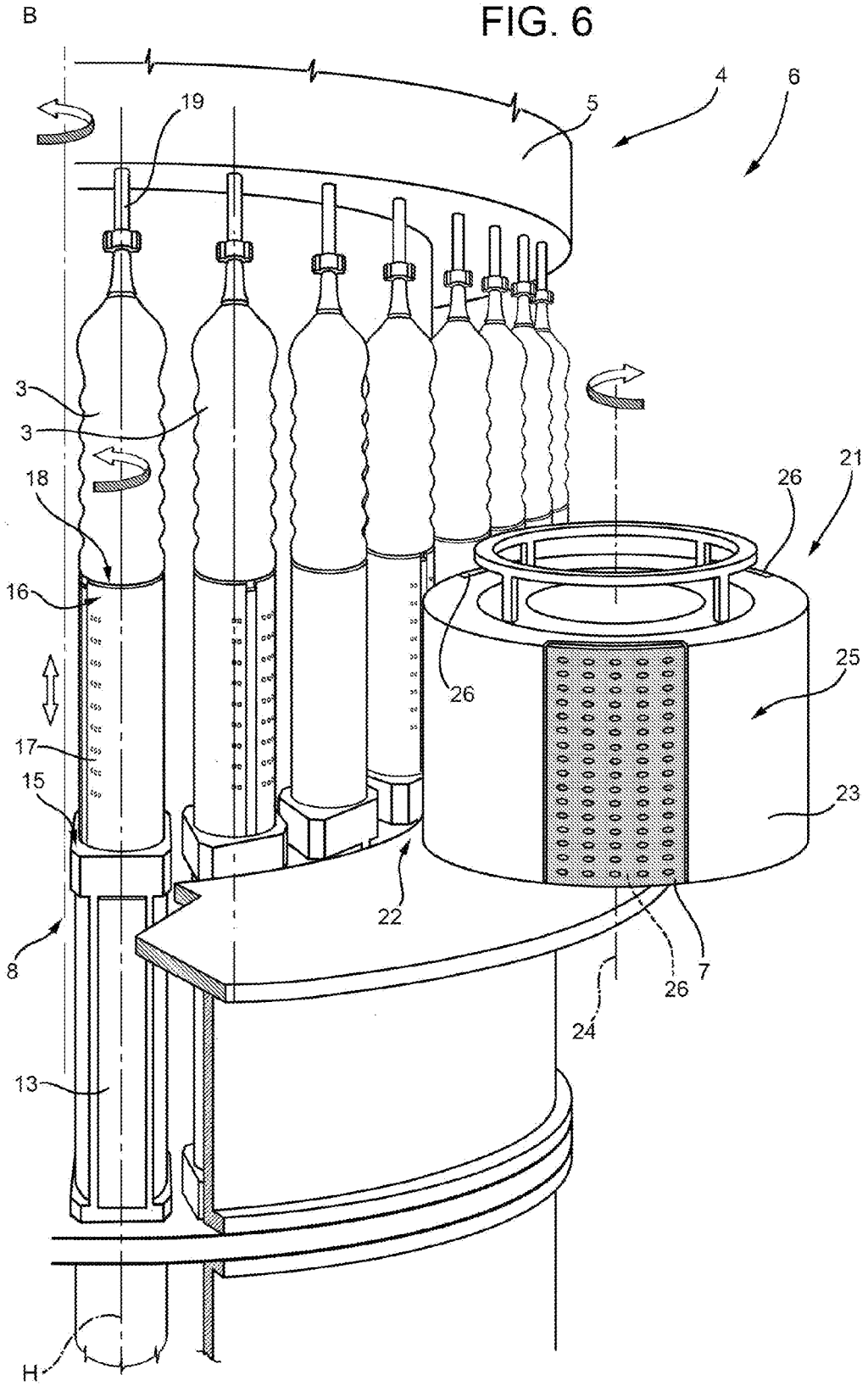
FIGS. 6 and 7 show two schematic views in perspective, with parts removed for clarity, of first details of the FIGS. 1 and 2 labeling machine.
Figure 7:
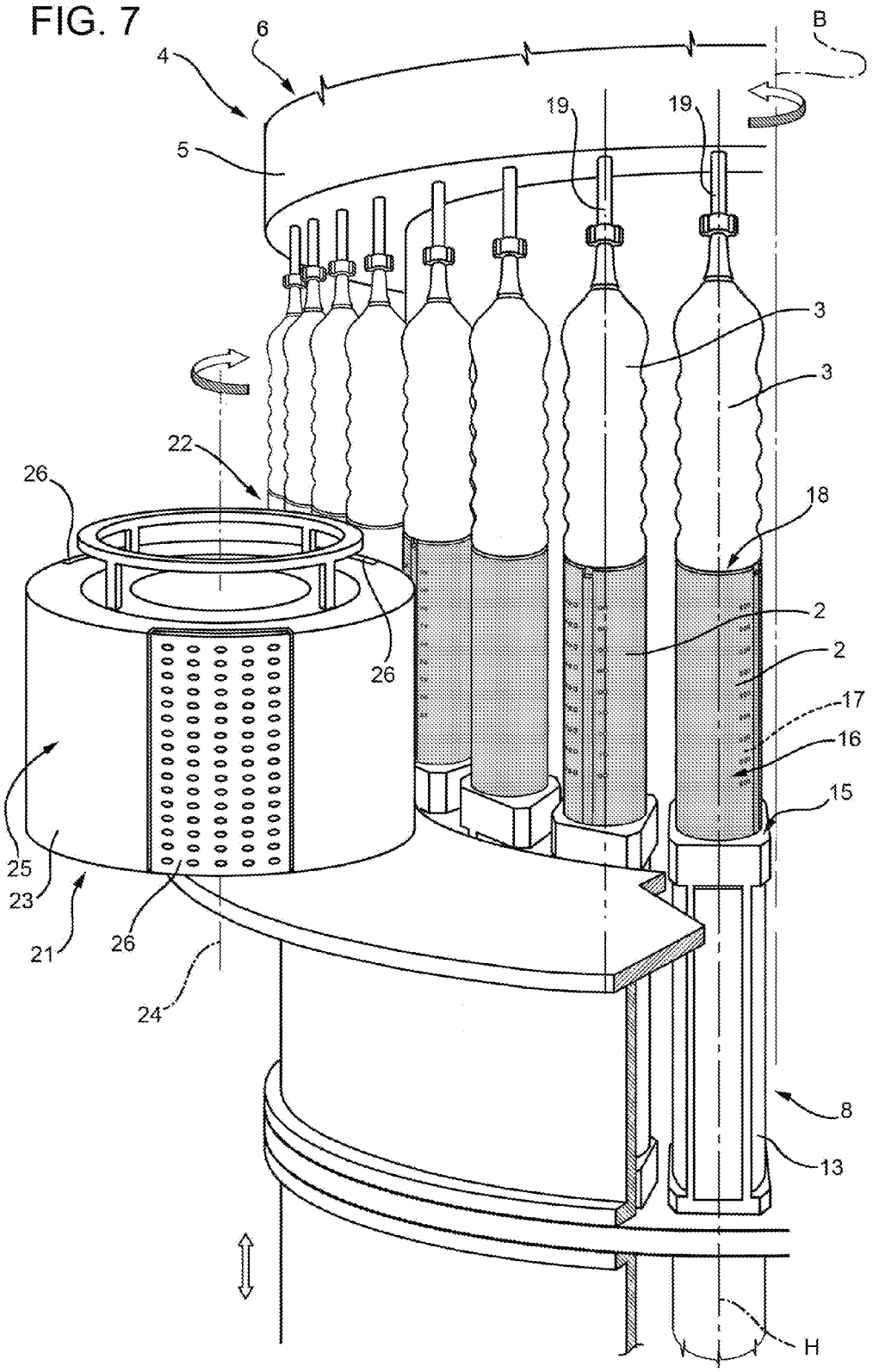

Module 1 is adapted to be incorporated into a labeling machine 6 (FIGS. 6 and 7).

In detail, labeling machine 6 applies labels 2 onto relative articles 3 in a first position while module 1 is adapted to move, if necessary, labels 2 relative to articles 3 from the first to a second position.

In the embodiment shown, the second position of labels 2 is raised relative to the first position of labels 2.

Very briefly, tubular labels 2 (commonly called "sleeve labels") are formed by labeling machine 6 through the steps of (FIGS. 6 and 7):

- cutting a web unwound from a supply roll into a plurality of flat rectangular or square label 7 of a heat-shrinkable material;
- bending each label 7 in a cylindrical configuration such that opposite vertical edges overlap one another, thus forming a relative tubular label 2; and
- welding the overlapped edges of each tubular label 2.

Figure 3:
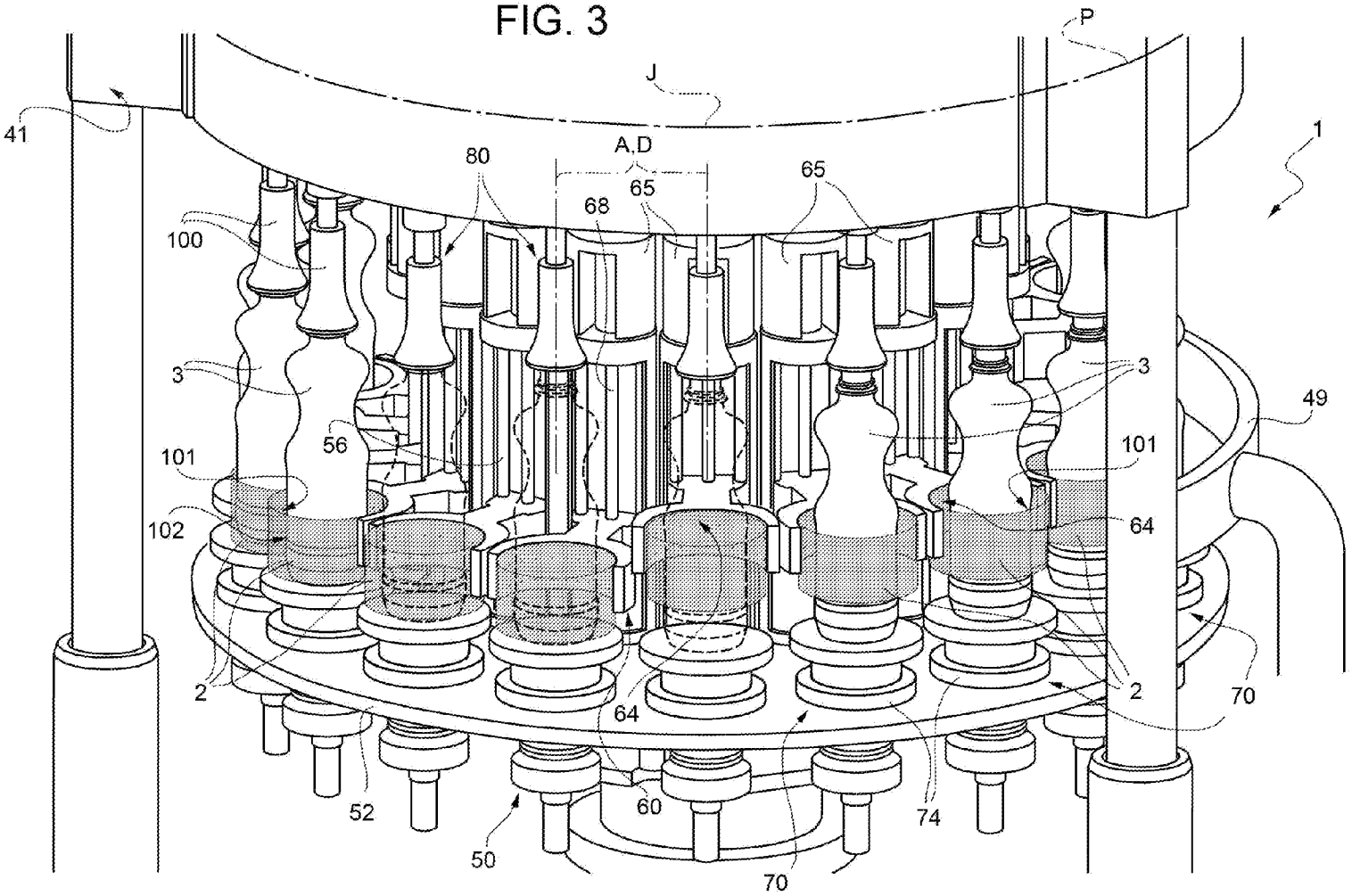
FIGS. 3 and 4 show an enlarged perspective frontal view of the vacuum transfer elements of FIGS. 1 and 2.

Furthermore, each tubular label 2 extends about its own axis A and comprises an inner side 101 facing axis A and an outer side 102, opposite to side 101 and to axis A (FIG. 3).

Each article 3 extends about its own axis, which coincides with axis A when relative tubular label 2 is applied thereon.

Labeling machine 6 substantially comprises (FIGS. 1 and 2):

- a linear conveyor 12 which extends along a direction Z and comprises an in-feed portion 28 and an out-feed portion 29 separated by a divider 39;
- an in-feed star wheel 9 fed with articles 3 to be labeled by in-feed portion 28 of conveyor 12;
- a carousel 4 fed by wheel 9 with articles 3 to be labeled at an input station Q and conveying articles 3 along an arc-shaped path R which extends from station Q to an output station S;
- an out-feed wheel 10 fed with labeled articles 3 by carousel 4 at output station S; and
- a feed device 21 for supplying labels 7, and which is connected to carousel 4 at a transfer station 22 arranged between stations Q and S (FIG. 7).

Direction Z is, in the embodiment shown, horizontal.

Out-feed portion 29 also defines an end station 90 of labeling machine 6.

Labeling machine 6 also comprises a worm-screw 37 which is arranged on the side of in-feed portion 28 opposite to carousel 4 and is adapted to form a queue of articles 3 separated by a given pitch.

In greater detail, carousel 4 rotates continuously about an axis B, which is vertical in the embodiment shown.

Path R extends about axis B.

Carousel 4 is also adapted to form tubular labels 2 and apply them onto relative articles 3 in respective positions relative to these articles 3, while the latter are advanced along path R.

In detail, carousel 4 comprises (FIGS. 6 and 7):

- a drum 5; and
- a number of carrier units 8 equally spaced about axis B and mounted along a peripheral edge of drum 5.

Each unit 8 comprises a tubular upright 13, which is fixed to drum 5, has a longitudinal axis H parallel to axis B, is bounded at the top by an annular surface 15 perpendicular to axis H, and is engaged in rotary and axially-sliding manner by a supporting spindle 16 coaxial with axis H.

Spindle 16 is bounded laterally by a cylindrical surface 17 coaxial with axis H and connectable to a known pneumatic suction device (not shown), and has a top plate (not shown) fitted in rotary and axially-fixed manner to spindle 16 and bounded by a top surface 18, which extends parallel to surface 15 and defines a supporting surface for a article 3.

Spindle 16 is movable—with respect to upright 13, along axis H, and by a known actuating device not shown—between a lowered position (not shown), in which spindle 16 is substantially housed inside upright 13, and surface 18 is substantially coplanar with surface 15, and a raised position, in which spindle 16 projects upwards from upright 13.

Spindle 16 cooperates with a top retaining member 19, which extends over spindle 16 parallel to axis H, is fitted in sliding and angular-fixed manner to drum 5, is movable along axis H with the same movement as spindle 16, and is designed to receive the neck of an article 3 and keep article 3 upright on surface 15.

Each unit 8 comprises a sealing bar 20, which is mounted between axes B and H, extends parallel to axis H above the plane defined by surfaces 15 of uprights 13, is of a length, measured parallel to direction 7, approximately equal to but no shorter than label 2, also measured parallel to direction 7, and is movable radially, with respect to drum 5, between a forward sealing position and a withdrawn rest position.

Device 21 comprises a feed drum 23, which is powered to rotate continuously about a respective longitudinal axis parallel to axis B, is bounded laterally by a cylindrical surface 25 coaxial with axis 24, and has a number of (in the example shown, three) suction areas 26, which are formed on surface 25, extend above the plane defined by surfaces 15, are equally spaced about axis 24, are connectable to the pneumatic suction device (not shown) to receive and retain one label 7 each, and are moved by drum 23 about axis 24 and through station 22.

In connection with the above, it should be pointed out that labels 7 are detached successively off a strip (not shown), and are fed onto surface 25 in a substantially flat, rectangular initial configuration.

Figure 1:
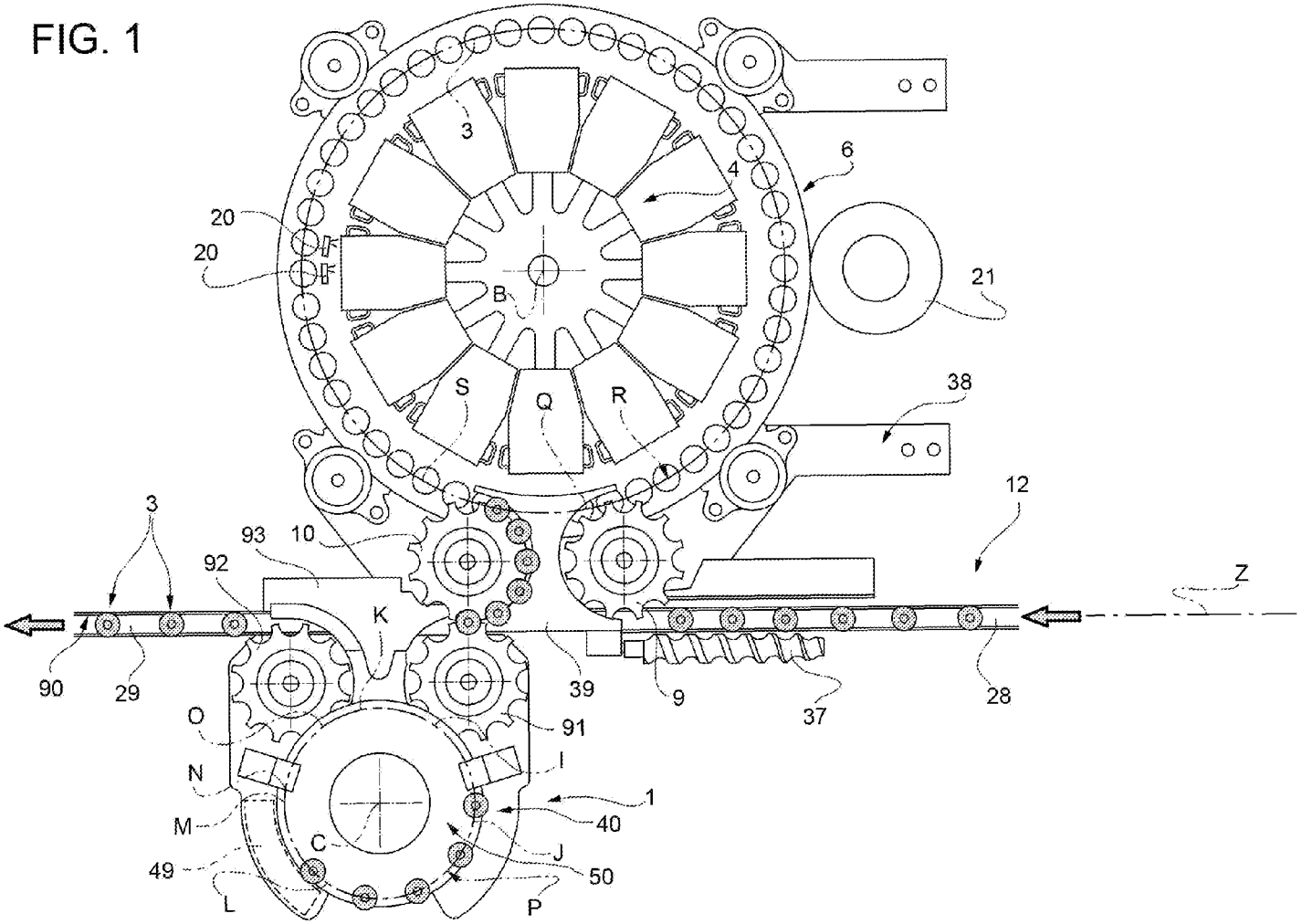
FIG. 1 shows a top view, with parts removed for clarity, of a first configuration of a labeling machine and of a module for the application of tubular labels onto relative articles, comprising a plurality of vacuum transfer elements according to the present subject matter.
Figure 2:
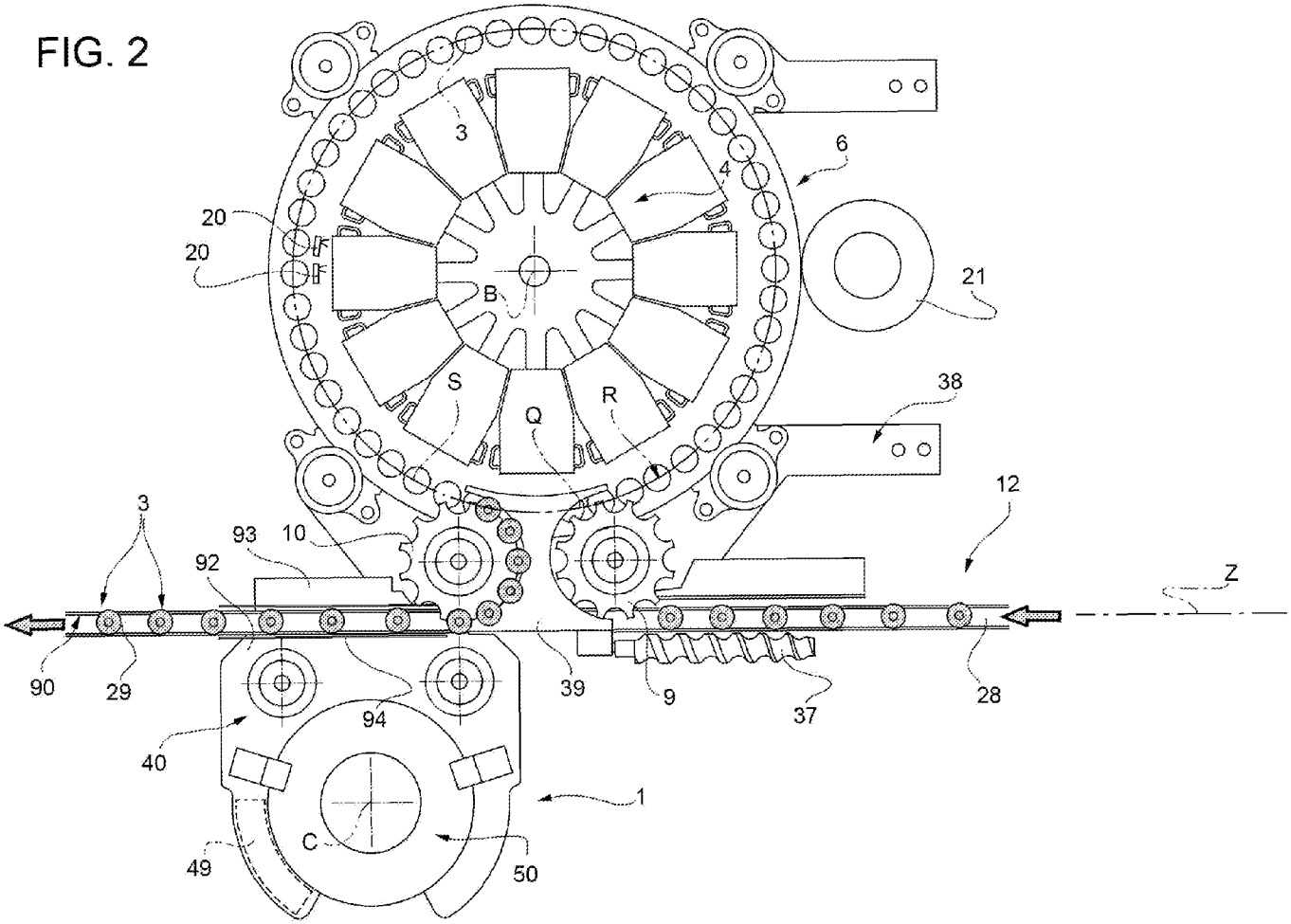
FIG. 2 shows a top view, with parts removed for clarity, of a second configuration of the labeling machine and the module of FIG. 1.

As shown in FIGS. 1 and 2, labeling machine 6 also comprises a frame 38 fitted to ground, rotatably supporting carousel 4 and wheels 9, 10, and supporting conveyor 29, divider 39 and worm-screw 37.

Module 1 comprises:

a carousel 50 (FIGS. 3 and 4) movable along a path P, and which is fed at an inlet station I of path P with a plurality of articles 3 onto which labels 2 have been applied at the first position, and which outputs at an outlet station O of path P articles 3 with labels 2 applied at a second position; and a plurality of vacuum transfer elements 60 (FIGS. 3 and 4) carried by carousel 50.

Each vacuum transfer element 60 comprises a surface 61 which may reciprocate along an its own axis E parallel to axis A, comprises a plurality of ports 62 and is adapted to cooperate with side 102 of a relative tubular label 2; ports 62 are selectively connectable to vacuum source 63 to establish vacuum suction action on side 102, when transfer element 60 moves from first to second position.

Advantageously, surface 61 of each vacuum transfer element 60 is angularly fixed relative to axis E.

In other words, each vacuum transfer element 60 does not rotate about relative axis E, but is simply driven by carousel 50 along path P.

Axes E are orthogonal to the plane of path P and vertical in the embodiment shown.

In detail, each vacuum transfer element 60 moves between the relative first and second position along axis E, when carousel 50 moves along path P.

Carousel 50 rotates continuously about an axis C which is vertical, in the embodiment shown and path P extends about axis C.

Path P further comprises:

a station J at which each vacuum transfer element 60 moves from the relative first to the relative second position; and a station K at which each vacuum transfer element 60 moves from the relative second position to the relative first position.

In detail, station J is arranged downstream of station I and upstream of station O, proceeding according to the rotating direction of carousel 50 about axis C.

Station K is arranged upstream of station O and downstream of station I, proceeding according to the rotating direction of carousel 50 about axis C.

Transfer elements 60 are movable along relative axes E parallel to and staggered from axis C.

Module 1 also comprises:

a stationary table 40 fitted to the ground; and a frame 41 (FIGS. 3 and 4) supported by table 40 and supporting carousel 50 rotatably about axis C.

Table 40 is fitted adjacent to portion 29 of conveyor 12.

Carousel 50 comprises (FIG. 5):

a shaft 46 rotatable about axis C;

a top disk 51 extending about axis C and lying on a plane which is horizontal in the embodiment shown;

a bottom disk 52 extending about axis C, parallel to disk 51, and arranged, in the embodiment shown, above disk 51;

a plurality of supporting elements 70 adapted each to support a bottom surface of a relative articles 3, and arranged at a peripheral edge of disk 51; and a plurality of retaining member 80 adapted each to receive a neck of a relative article 3 and to keep relative article 3 upright onto corresponding supporting element 70, and arranged at a peripheral edge of disk 52.

Carousel 50 also comprises a top flange 47 radially interposed between shaft 46 and disk 51, and a bottom flange 48 radially interposed between shaft 46 and disk 52.

In detail, each supporting element 70 extends along a relative axis D parallel to axis C and comprises:

a shaft 71 rotatable about a relative axis D;

a tubular body 72 fitted to shaft 71 and defining a planar circular supporting surface 73 for a relative article 3;

a tubular body 74 fitted to disk 52 and rotatable about axis C together with disk 52; and a plurality of bearings 75 interposed between shaft 71 and body 72, so as to allow the rotation of shaft 71 and body 72 relative to body 74 and disk 52 about axis D.

Axis D is, in the embodiment shown, vertical and coincides with axis A when article 3 with tubular label 2 applied thereon is supported by surface 73.

Each retaining member 80 extends along a relative axis D and is arranged above corresponding supporting element 70.

Furthermore, each retaining member 80 comprises:

a sleeve 81 which is fixed to disk 51 and is, therefore, stationary relative to axis D;

a roller 82 cooperating with a groove cam 53 and Movable upwards and downwards relative to disk 51;

a guide element 83 connected to roller 82 and movable along axis D; and a rod 84 which may slide along axis D and is connected to guide element 83.

In detail, cam 53 is stationary relative to axis C and defines a groove 54 extending around axis C and at varying distances from disk s 51, 52.

Sleeve 81 defines a shoulder 85 and a cup element 86 open on the opposite side of disk 51 is fixed to shoulder 85.

Guide element 83 comprises:

a sleeve 87 partly housed within sleeve 81 and connected to roller 82;

a cup element 88 open on the side of disk 51, and arranged above and connected to sleeve 87; and a cup element 89 open towards disk 51 and connected to cup element 86 by a helical spring 79.

Rod 84 has a top end 76 connected to cup element 89 through a helical spring 78 and a bottom end 77 engaging a bell-shaped element 100.

In detail, each retaining member 80 is movable along relative axis D between:

a raised position; and a lowered position in which bell-shaped element 100 receives the neck of a corresponding article 3 and keeps relative article 3 upright onto corresponding supporting element 70.

In particular, rod 84 and, therefore, bell-shaped elements 100 move from relative raised positions to relative lowered positions immediately downstream of inlet station I of path P, so as to keep articles 3 against relative surfaces 73.

Rod 84 and, therefore, bell-shaped elements 100 move from relative lowered positions to relative raised positions immediately upstream of outlet station O of path P, so as to allow the release of articles 3.

In particular, the ascending (descending) movement of roller 82 causes the ascending (descending) movement of guide element 83, spring 78 and rod 84 along axis D. Accordingly, spring 79 is compressed (extended).

Furthermore, spring 78 damps the impact of bell-shaped element 100 against the neck of article 3, when bell-shaped element 100 reaches the lowered position.

Frame 41 comprises:

a top disk 42 fitted to table 40 through a plurality of vertical columns;

a sleeve 43 relative to which shaft 46 may rotate about axis C through the interposition of bearings 45; and a bottom disk 44 interposed between disk 42 and sleeve 43.

Disk 44 supports cam 53.

Each transfer element 60 is movable along axis E and is radially interposed between axes C, D. Axis E is, in the embodiment shown, parallel to axes C, D.

Furthermore, each transfer element 60 is associated to a relative supporting element 70 and to a corresponding retaining member 80.

Carousel 50 comprises, for each transfer element 60, a hollow cylindrical element 65 extending about axis E and fitted to disk 51. In detail, element 65 extends on both sides of disk 51.

In the following of the present description, it is described only one transfer element 60, being all transfer elements 60 identical to each other.

Each transfer element 60 comprises (FIGS. 4 and 5):

an actuating rod 68 which may slide parallel to axis E relative to element 65;

a pair of guide rods 67 extending parallel to axis E and arranged on opposite lateral sides of rod 68; and a vacuum element 69 connected to rods 67, 68 and defining surface 61.

More precisely, rod 68 has:

a top axial end 58 which is opposite to vacuum element 69;

a bottom axial end 59 connected to vacuum element 69 and opposite to end 58: and a stem interposed between ends 58, 59.

In detail, element 65 defines a cavity 66 within which end 58 may slide relative to axis E.

The outer diameter of end 58 substantially equals the inner diameter of cavity 66.

In this way, end 58 separates cavity 66 in two top and bottom chamber 120, 121 which may be fluidly connected, through a not-shown electro-valve, either to not-shown pressure source or to the environment pressure.

More precisely, when rod 68 and, therefore, transfer element 60 must move downwards along axis E, the pressure inside chamber 120 is made greater than the pressure inside chamber 121.

Conversely, when rod 68, and, therefore, transfer element 60 must move upwards along axis E, the pressure inside chamber 121 is made greater than the pressure inside chamber 120.

Each rod 67 furthermore slides within a not-shown hole defined by element 65.

Each rod 67 comprises:

a top axial end which may slide through a relative not-shown hole defined by element 65; and a bottom end 56, which is opposite to top end and is connected to vacuum element 69.

Vacuum element 69 is hand-shaped and comprises (FIG. 4):

two annular plates 34, 35 parallel to each other and lying on relative planes parallel to axis E;

surface 61 which extends between plates 34, 35 on the opposite side of axis C and is, in the embodiment shown, vertical; and a surface 36 which is opposite to surface 61 and bounds vacuum element 69 on the side of axis C.

In detail, plate 34 is connected to ends 56 of rods 67. Rod 68 passes through vacuum element 69 and end 59 abuts against plate 35.

Surface 61 is concave on the opposite side of axis C.

In the embodiment shown, surface 61 is C-shaped in a cross section orthogonal to axis E.

Figure 4:
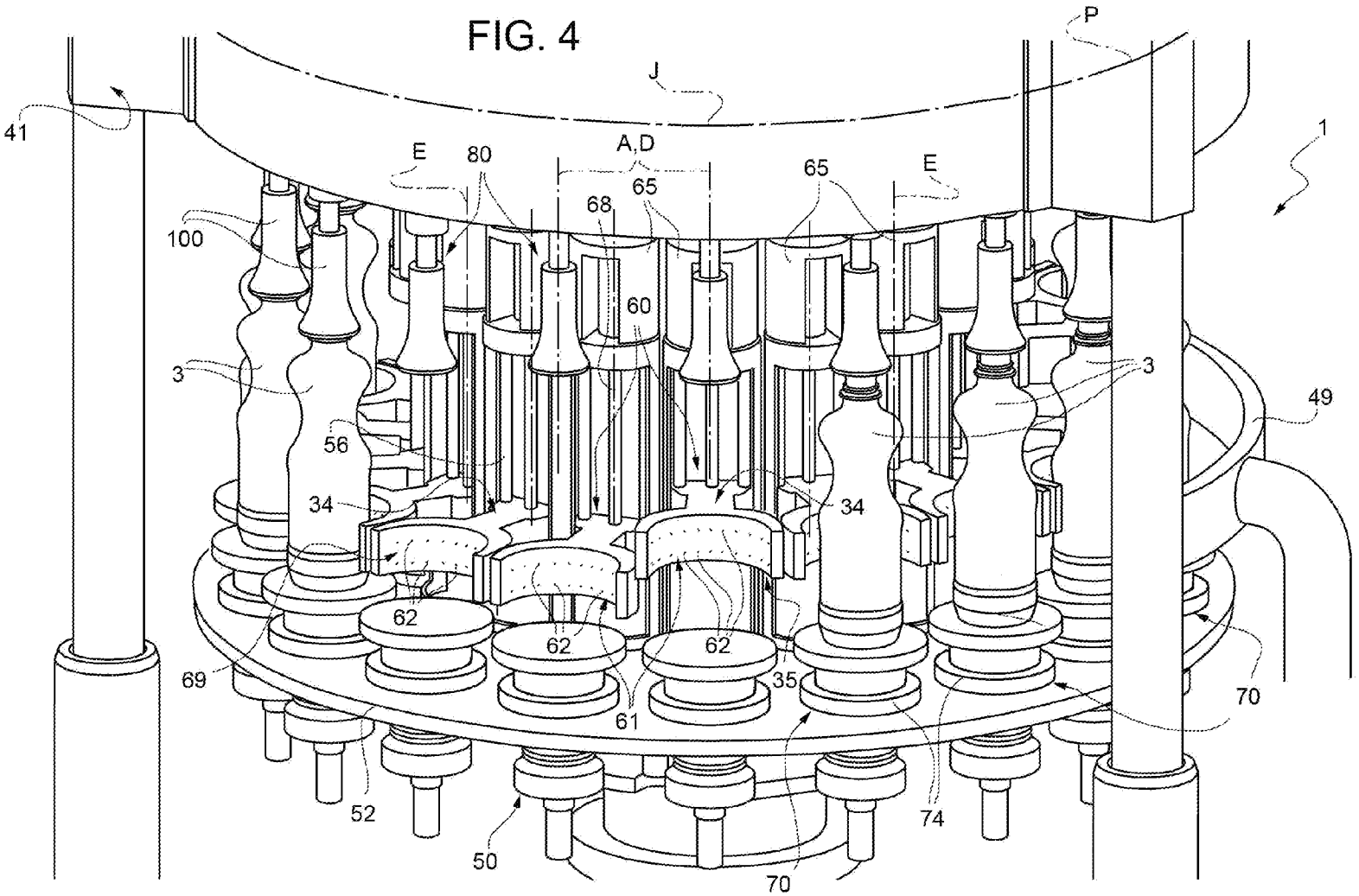
Figure 5:
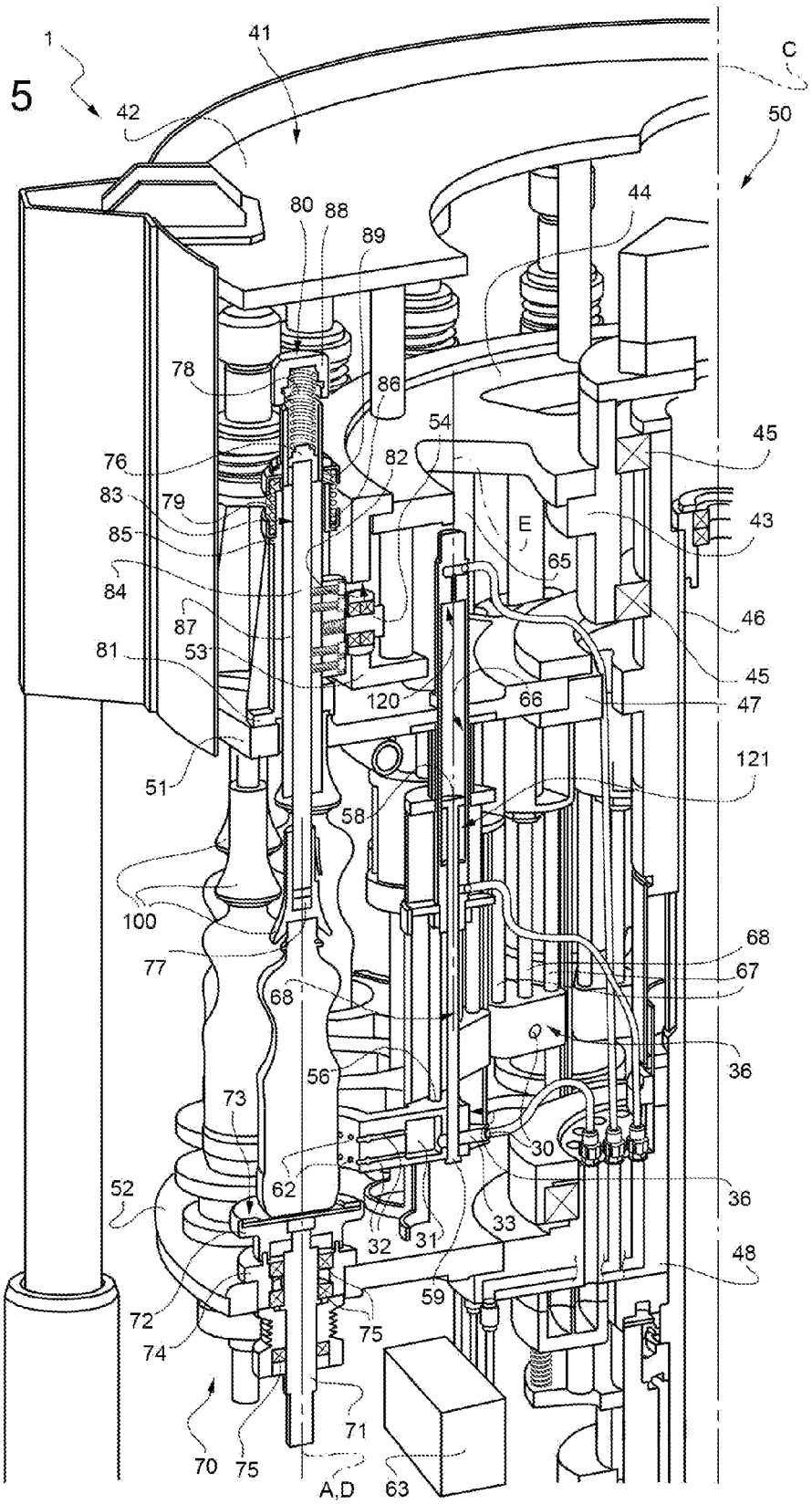
FIG. 5 shows in an enlarged view a cross-section of some components of the module of FIGS. 1 to 4.

Furthermore, surface 61 defines a C-shaped seat 64 which is engaged by a portion of article 3 (FIG. 4).

Each vacuum element 69 comprises (FIG. 5):

a port 30 defined by a connector protruding from surface 36;

an annular manifold 31 which extends around axis D;

a plurality of fluidic lines 32 extending radially to axis D and connecting ports 62 with manifold 31; and a fluidic line 33 extending radial to axis D, arranged on the opposite side of manifold 31 relative to lines 32 and fluidly connecting manifold 31 with port 30.

Port 30 is selectively connectable to vacuum source 63 through a pneumatic distributing system.

More precisely, port 30 and, therefore, ports 62 are fluidly connected to vacuum source 63 when transfer element 60:

is arranged in the first position between station I, J, so that label 2 is suctioned by transfer element 60;

moves together with label 2 from the first position to the second position at station J; and is arranged in the second position and moves from station J to a station N which is immediately upstream of station O, so as to maintain label 2 in the second position up to station N.

Conversely, port 30 and, therefore, ports 62 are fluidly disconnected from vacuum source 63 when transfer element 60 moves from station N to station I.

In the embodiment shown, vacuum source 63 is stationary and is carried by module 1.

Table 40 also supports a stationary pre-heating element 49 which heats and, therefore, at least partially heat-shrinks labels 2 arranged in the second position onto relative articles 3 (FIGS. 1, 2 and 3).

In detail, element 49 is arranged on the opposite radial side of supporting elements 70 (and retaining elements 80) relative to axis C.

Element 49 extends as from a station L which is downstream of station J to a station M in which is upstream of station O, with reference to the advancing sense of articles 3 along path P. Station N is arranged between station M and station O.

Labeling machine 6 may be arranged:

either in a first configuration (FIG. 1) in which module 1 receives articles 3 having labels 2 in the first position and feeds portion 29 of conveyor 12 with articles 3 having relative labels 2 in the second position; or in a second configuration (FIG. 2) in which module 1 is by-passed by articles 3 and wheel 10 feeds portion 29 of conveyor 12 with articles 3 having relative labels 2 arranged in respective first positions.

In detail, when labeling machine 6 must be operated in the first configuration, table 40 is fitted with (FIG. 1):

an in-feed star-wheel 91 interposed between wheel 10 and inlet station I of carousel 50;

an out-feed star-wheel 92 interposed between station O of carousel 50 and portion 29 of conveyor 12; and a fixed dividing element 93, which is arranged between wheels 91, 92 and between carousels 50, 4 and crosses over portion 29 of conveyor 12.

More precisely, table 40 supports wheels 91, 92 rotatably about relative axes parallel to axis C and vertical, in the embodiment shown.

When labeling machine 6 must be operated in the second configuration, star-wheels 91, 92 and dividing element 93 are dismounted from table 40, as shown in FIG. 2.

Furthermore, table 40 is fitted with a stationary guide 94, which extends parallel to portion 29 of conveyor 12 and bounds portion 29 on the side of carousel 50.

Guide 94 comprises a plurality of rails parallel to portion 29 and is adapted to laterally contain article 3 which travels onto portion 29.

Operation of module 1 and of labeling machine 6 will now be described with reference to one article 3, to corresponding label 2 and to corresponding transfer element 60.

Furthermore, operation of labeling machine 6 will now be described with reference to one unit 8, and as of the instant in which unit 8 moves downstream of wheel 9, with its spindle 16 in the lowered position, to receive article 3 from worm-screw 37.

Spindle 16 cooperates with respective retaining member 19 to keep article 3 upright on surface 18, moves to the raised position, and is fed by carousel 4 through station 22 in time with a suction area 26, so as to transfer a label 7 onto surface 17.

Spindle 16 is rotated about its axis H to wind label 7 completely about spindle 16 into a tubular configuration having a longitudinal overlap, which is defined by superimposed portions of label 7, and is heat sealed longitudinally by respective sealing bar 20, so that label 2 is approximately equal, but no smaller, in diameter than a article 3.

In this way, a tubular label 2 is formed by a flat label 7.

Once label s is sealed, and by combining the movement of spindle 16 inside upright 13 with deactivation of the pneumatic suction device (not shown), label 7 is released from surface 17 of spindle 16, is retained on upright 13 by surface 15 of upright 13, and is engaged in sliding manner by article 3.

In particular, label 2 is arranged in the first position relative to article 3.

In case that label 2 needs to be applied onto relative article 3 in the corresponding first positions, module 1 is by-passed.

In detail, wheels 91, 92 and dividing element 93 are removed from table 40.

Furthermore, guide 94 is fitted to table 40.

In this way, wheel 10 feeds portion 29 of conveyor 12 with article 3 having label 2 in the first position.

Article 3 travelling onto portion 29 is then laterally contained by guide 94 and reaches end station 90.

In case that label 2 needs to be applied onto relative article 3 in the corresponding second positions, guide 94 is removed from table 40; and table 40 is fitted with wheels 91, 92 and dividing element 93, so that article 3 is conveyed towards module 1.

The operation of module 1 will now be described with reference to one supporting member 70 and to one retaining member 80, and starting from a condition in which vacuum transfer element 60 is in the first position and ports 62 are fluidly connected to vacuum source 63.

Wheel 10 moves away article 3—with label 2 applied in the first positions—from carousel 4 and feeds this article 3 to wheel 91.

Wheel 91, in turn, feeds carousel 50 with article 3 having label 2 applied in the first position. More precisely, wheel 91 feeds station I of path P with article 3.

Carousel 50 advances article 3 from station I to station O of path P.

In detail, at station I, article 3 is supported by surface 73 of retaining element 70 and label 2 is suctioned by surface 61 of transfer element 60. In other words, when it is arranged in the first position, the bottom edge of label 2 contacts surface 73.

Rod 84 is lowered from raised to lowered position, immediately downstream of station I, so that bell-shaped element 100 receives the neck of article 3.

In particular, cam 53 moves downwards roller 82, causing the extension of spring 78.

As a result, guide element 83 and rod 84 move downwards, thus compressing spring 79.

As a result of the downwards movement of rod 84, bell-shaped element 100 receives the neck of article 3.

In this situation, spring 78 is compressed to bump the impact bell-shaped element 100 and the neck of article 3.

Accordingly, as it reaches station J, article 3 is supported by surface 73 and its neck engages bell-shaped element 100.

At station J, transfer element 60 moves label 2 relative to article 3 from the first to the second position.

In particular, when it is arranged in the first position, the bottom edge of label 2 is above and separated for a certain vertical distance from surface 61.

In detail, pressure inside chamber 121 is made greater than pressure inside chamber 120. Accordingly, rod 68 and, therefore, vacuum element 69 is raised from the first to the second position. At the same time, guide elements 67 are raised parallel to axis E.

As article 3 further advances along path P, pre-heating element 49 generates a flux of hot air onto the portion of label 2 which is opposite to axis C, thus pre-shrinking label 2.

In detail, the flux of hot air is generated between stations L, M of path P.

As a consequence, at least the portion of label 2 facing heating element 49 is preliminary fixed to article 3 in the second position.

In case that the whole surface of label 2 needs to be pre-heated, shaft 71 and, therefore, tubular body 72 with surface 73 is rotated about axis D.

Once that label 2 has been pre-fixed to article 3 in the position, ports 62 are fluidly disconnected by vacuum source 63 at station N.

In this way, label 2 is released from vacuum element 50.

Bell-shaped 100 moves from the lowered to the raised position immediately upstream of station O.

In particular, cam 53 moves upwards roller 82, causing the compression of spring 78.

As a result of the upward movement of roller 82, also guide element 83, rod 84 and bell-shaped element 100 move upwards along axis D relative to article 3.

As a result of this upwards movement of rod 84, bell-shaped element 100 detaches from the neck of article 3.

Afterwards, article 3 with label 2 into the second position reaches station O and is fed to wheel 92 and to portion 29 of conveyor 12.

Finally, portion 29 of conveyor 12 moves article 3 to end station 90.

Transfer element 60 reaches station K and moves from the second to the first position.

Regardless the position of label 2 relative to article 3, the latter are conveyed to a not-shown oven, in which the heat-shrinking of labels 2 and the fixing of labels 2 to articles 3 is completed.

The advantages of vacuum transfer element 60 and of the method according to the present subject matter will be clear from the above description.

In particular, labels 2 are transferred from the respective first to the respective second position, by using the vacuum action exerted by ports 62 of vacuum transfer element 60.

Accordingly, the positioning of labels 2 in the second position is highly repeatable, precise and can be carried out at a very high speed.

Furthermore, labels 2 may be arranged in a wide range of second positions relative to articles 3, by simply controlling the length of the stroke of transfer element 60.

Module 1 also provides for a very simply up-grade of an existing labeling machine 6. In particular, this up-grade does not require the re-design of any component of labeling machine 6.

As a matter of fact, in order to up-grade an existing labeling machine 6, it is enough to mount wheels 91, 92 and dividing element 93 on table 40 and to put wheel 91 in circumferential contact with wheel 10.

Finally, labeling machine 6 may be very easily arranged either in:

a first configuration, in which module 1 receives articles 3 with labels 2 in the first position at station I and feeds articles 3 with labels 2 in the second position at station O;

or in a second configuration, in which module 1 is by passed and labeling machine 6 outputs articles 3 with labels 2 in the second position.

As a matter of fact, in order to switch labeling machine 6 from the first to the second configuration, it is enough to remove wheels 91, 92 and dividing element 93 from table 40 and to mount guide 94 on table 40.

Clearly, changes may be made to module 1 and to the method as described and illustrated herein without, however, departing from the scope of protection as defined in the accompanying claims.

The invention claimed is:

1. A vacuum transfer element for transferring a tubular label having a first axis (A) from a first to a second position, comprising:

a first surface which may reciprocate along a second axis (E) parallel to said first axis (A), comprises a plurality of ports and is adapted to cooperate with an outer side, opposite to said first axis (A), of said tubular label;

said first ports being selectively connectable to a vacuum source to establish a vacuum suction onto said outer side, at least when said first surface moves from said first to said second position, wherein said first surface is angularly fixed relative to said second axis (E);

an actuating element movable along said second axis (E); said actuating element comprising: a first end adapted to receive an action directed along said second axis (E), and a second end;

at least one guide element movable along said second axis (E); and a body which defines a first surface and a second surface, said body comprising a first and a second plate opposite to each other, wherein said first and second surfaces are opposite to each other and axially interposed between said first and second plate;

wherein said actuating element passes through said body, wherein said second is being fixed to said second plate, wherein said first is arranged on the opposite side of said first plate relative to said second plate; and wherein said guide element is fixed to said first plate.

2. The vacuum transfer element of claim 1, wherein said first surface is concave.

3. The vacuum transfer element of claim 1 or 2, wherein said first surface defines a seat which may be engaged by at least part of an article.

4. The vacuum transfer element of claim 1, wherein said second surface defines a second port fluidly connectable in a selective way to said vacuum source;

said body further comprising a manifold fluidly connected to said first and second ports.

5. A module for the application of a tubular label onto an article, comprising:

a first conveyor movable along a path (P), and which may be fed at an inlet station (I) of said path (P) with said article onto which said tubular label has been applied at a first position, and which outputs at an outlet station (O) of said path (P), in use, said article with said tubular label applied at a second position; and a vacuum transfer element for transferring a tubular label having said first axis (A) from a first to a second position, comprising:

a first surface which may reciprocate along a second axis (E) parallel to said first axis (A), comprises a plurality of ports and is adapted to cooperate with an outer side, opposite to said first axis (A), of said tubular label;

said first ports being selectively connectable to a vacuum source to establish a vacuum suction onto said outer side, at least when said first surface moves from said first to said second position;

wherein said first surface is angularly fixed relative to said second axis (E);

wherein said first conveyor comprises supporting means for supporting said article; said supporting means comprising a supporting surface rotatable about said first axis (A) relative to said first conveyor.

6. The module of claim 5, wherein said second axis (E) is transversal to said path (P);

said vacuum transfer element being movable between said first and second said position parallel to said second axis (E), when said first conveyor moves along said path (P).

7. The module of claim 5 or 6, wherein said vacuum transfer element is movable together with said first conveyor along said path (P).

8. The module of claim 5, wherein said vacuum transfer element is controllable in such a way that it moves from said first towards said second position, when said first conveyor is in an intermediate station (J) of said path (P);

said intermediate station being arranged between said inlet and outlet station (I, O) of said path (P).

9. The module of claim 5, comprising a pre-heating element adapted to pre-heat at least one portion of said tubular label applied onto said article at said second position, so as to fix said tubular label in said second position;

said pre-heating element being configured to heat said tubular label from a further first station (L) to a further second station (M) of said path (P);

said further first station (L) being arranged between said intermediate station (J) and said further second station (M);

said further second station (M) being arranged upstream of said output station (O), with reference to the advancing sense of said article along said path (P).

10. The module of claim 9, wherein said pre-hating element is stationary relative to said first conveyor and comprises an arm surrounding a portion of said path (P);

said arm extending between said first and second station (L, M).

11. The module of claim 5, comprising a vacuum source selectively connectable to said ports;

said vacuum source being fluidly connected, in use, to said ports at least when said transfer element moves from said first to said second position, so as to transfer said tubular label from said first and second position relative to said article;

said vacuum source being fluidly disconnected, in use, from said ports, when said transfer element moves from said second to said first position.

12. The module of claim 11, wherein said vacuum source may be fluidly connected to said ports also when said transfer element is arranged in said first position and moves from said inlet station (I) to said intermediate station (J).

13. The module of claim 5, wherein said vacuum transfer element comprises an actuating element;

wherein said first conveyor defines a cavity within which said actuating element may slide; said actuating element dividing said cavity in a first and a second chamber which are selectively and alternatively connectable, in a fluidic way, to a pressure source, so as to move said actuating element along said second axis (E).

14. The module of claim 13, wherein said first conveyor comprises an element through which said actuating element and said guide elements may slide along said second axis (E).

15. A labeling machine, comprising:

a forming group adapted to form a tubular label with opposite edges overlapped and welded to one another, starting from a sheet of heat-shrinkable material;

an application group adapted to said tubular label to said relative article at said first position;

a second conveyor defining an output end of said labeling machine; and a module comprising:

a first conveyor movable along a path (P), and which may be fed at an inlet station (I) of said path (P) with said article onto which tubular label has been applied at a first position, and which outputs at an outlet station(O) of (P), in use, said article with said tubular label applied at a second position, and a vacuum transfer element for transferring a tubular label having a first axis (A) from a first to a second position, comprising:

a first surface which may reciprocate along a second axis (E) parallel to said first axis (A), comprises a plurality of ports and is adapted to cooperate with an outer side, opposite to said first axis (A), of said tubular label, said first ports being selectively connectable to a vacuum source to establish a vacuum suction onto said outer side, at least when said first surface moves from said first to said second position, wherein said first surface is angularly fixed relative to said second axis (E), wherein it may be selectively arranged in:

either in a first configuration, in which said module may be fed with said article having said tubular label arranged in relative said first position, and in which said module feeds, in use, said output end with said article having said tubular label arranged in said second position;

or in a second configuration, in which said module may be by-passed, and said output end is fed by said application group with said article having said tubular label arranged in said first position.

16. The labeling machine of claim 15, wherein said module comprises a table rotatably supporting said first conveyor about said first axis (A);

said table further rotatably supporting, when said labeling machine is in said first configuration:

a first wheel interposed between said application group and said first conveyor, and adapted to feed said first conveyor with said article onto which said tubular label has been applied at said first position; and a second wheel interposed between said first conveyor, and said output end and adapted to receive from said first conveyor said article onto which said tubular label has been applied in said second position;

said table supporting, when said labeling machine is in said second configuration and instead of said first and second wheel, a fixed guide adapted to laterally contain said article with said tubular label as it travels onto a final portion of said second conveyor; said final portion defining said output end.

17. A method for transferring a tubular label having a first axis (A) and intended to be applied onto an article from a first to a second position, comprising the steps of:

contacting an outer side opposite to said first axis (A) of said tubular label with a surface of a vacuum transfer element;

establishing vacuum at a plurality of ports of said surface; and moving said surface from said first to said second position along a second axis (E) of said vacuum transfer element parallel to said first axis (A), during said step of establishing vacuum;

comprising the step of maintaining said surface angularly fixed relative to said second axis (E);

forming said tubular label with opposite edges overlapped and welded to each other, starting from a sheet of heat-shrinkable material;

applying said tubular label to a relative article in a first position;

feeding said article with said tubular label applied in said first position at a second conveyor, within a labeling machine; and in case said tubular label must be applied onto said article at said second position, feeding said module with said article having said tubular label applied at said first position and feeding an output end of said labeling machine with said article having said tubular label applied at said second position; or in case said tubular label must be applied onto said article at said first position, by-passing said module and feeding an output end of said labeling machine with said article having relative tubular label applied at said first position.

18. The method of claim 17, comprising the step of engaging an article onto which said tubular label has been previously applied in said first position inside a seat defined by said surface.

19. The method of claim 17 or 18, comprising the steps of:

feeding an inlet station (I) of a first conveyor of a module with said article onto which said tubular label has been applied at a first position;

advancing said first conveyor along a path (P) extending from said inlet to an outlet station (I, O);

feeding said outlet station (O) with said article with said tubular label applied thereon at said second position;

said step of moving being carried out during said step of advancing.

20. The method of claim 19, wherein said step of moving is carried out at an intermediate station (J) between said inlet and said outlet station (I, O).

21. The method of claim 20, wherein said step of establishing vacuum comprises the step of establishing vacuum at said ports also when said transfer element moves from said inlet station (I) to said intermediate station (J).

22. The method of claim 20, comprising the step of pre-heating said tubular label arranged in said second position;

said step of pre-heating being carried out between a further first station (L) and a further second station (M) of said path (P);

said further first station (L) being arranged between said intermediate station (J) and said further second station (M);

said further second station (M) being arranged upstream of said output station (O), with reference to the advancing sense of said article along said path (P).

23. The method of claim 22, wherein said step of pre-heating comprises the step of using a stationary pre-heating source relative to said path (P);

said step of advancing comprising the step of rotating said article with said tubular label arranged relative to said stationary pre-heating source.

24. The method of claim 17 comprising, in case said tubular label must be applied at said second position, the steps of:

mounting a first wheel on a table of said module between said labeling machine and said first conveyor;

mounting a second wheel on said table and between said first conveyor and a portion of a second conveyor defining said output end;

conveying said article with said tubular label applied thereon in said first position from said labeling machine to said first wheel and from said first wheel to said first conveyor; and conveying said article with said tubular label applied thereon in said second position from said first conveyor to said second wheel and from said second wheel to said output end;

the method also comprising the steps, in case said tubular label must be applied onto said article at said first position, the steps of:

removing said first and second wheel from said table;

mounting a fixed guide on said table;

feeding said portion of said second conveyor with said article having said label applied in said first position; and laterally containing said article travelling onto said portion and toward said output end by using said guide.

* * * * *